US010859023B2

(12) United States Patent
Kuempel et al.

(10) Patent No.: US 10,859,023 B2
(45) Date of Patent: Dec. 8, 2020

(54) METHOD FOR ASCERTAINING A SETPOINT VALUE FOR A MANIPULATED VARIABLE FOR ACTIVATING A LOW-PRESSURE PUMP

(71) Applicant: Robert Bosch GmbH, Stuttgart (DE)

(72) Inventors: Joerg Kuempel, Ludwigsburg (DE); Michael Bauer, Gerlingen (DE); Alexander Schenck Zu Schweinsberg, Moeglingen (DE); Klaus Joos, Walheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/079,375

(22) PCT Filed: Mar. 8, 2017

(86) PCT No.: PCT/EP2017/055420
§ 371 (c)(1),
(2) Date: Aug. 23, 2018

(87) PCT Pub. No.: WO2017/157736
PCT Pub. Date: Sep. 21, 2017

(65) Prior Publication Data

US 2019/0063359 A1 Feb. 28, 2019

(30) Foreign Application Priority Data

Mar. 17, 2016 (DE) ..... 10 2016 204 408

(51) Int. Cl.
*F02D 41/24* (2006.01)
*F02D 41/38* (2006.01)

(52) U.S. Cl.
CPC ..... *F02D 41/2464* (2013.01); *F02D 41/3854* (2013.01); *F02D 41/3845* (2013.01);
(Continued)

(58) Field of Classification Search
CPC ..... F02D 41/24; F02D 41/2464; F02D 41/38; F02D 41/3854; F02D 2200/0602; F02D 2200/0606
(Continued)

(56) References Cited

U.S. PATENT DOCUMENTS 4,667,638 A * 5/1987 Igashira ..... F02M 47/02 123/179.17
5,884,606 A * 3/1999 Kellner ..... F02M 37/0029 123/446
(Continued)

FOREIGN PATENT DOCUMENTS

DE 19548280 A1 6/1997
DE 101 58 950 A1 6/2003
(Continued)

OTHER PUBLICATIONS

International Search Report for PCT/EP2017/055420, dated May 31, 2017.

*Primary Examiner* — John Kwon
*Assistant Examiner* — Johnny H Hoang
(74) *Attorney, Agent, or Firm* — Norton Rose Fulbright US LLP; Gerard Messina

(57) ABSTRACT

A method for ascertaining a setpoint value for a manipulated variable for activating a low-pressure pump in a fuel supply system for an internal combustion engine, including a high-pressure accumulator and a high-pressure pump including a volume control valve, the low-pressure pump being activated in such a way that a pressure provided by the low-pressure pump is reduced across multiple intake phases, in which fuel delivered by the low-pressure pump is sucked in by the high-pressure pump via the volume control valve, the volume control valve being at least temporarily held in a closed position during each of the multiple intake phases, in which it may be opened from a side facing the low-pressure
(Continued)

pump, and the setpoint value being ascertained, taking into account an activating value of the manipulated variable, in which a drop in the delivery rate of the high-pressure pump is detected.

18 Claims, 4 Drawing Sheets

(52) U.S. Cl.
CPC ..... *F02D 2200/0602* (2013.01); *F02D 2200/0606* (2013.01)

(58) Field of Classification Search
USPC ..... 701/101–103, 110, 114, 115; 123/445–448, 456, 495–497, 505, 123/516–519
See application file for complete search history.

(56) References Cited

U.S. PATENT DOCUMENTS 6,027,312 A * 2/2000 Djordjevic ..... F02M 39/005 123/446
6,113,361 A * 9/2000 Djordjevic ..... F02M 39/005 123/456
6,240,901 B1 * 6/2001 Jay ..... F02M 53/02 123/446
6,714,853 B2 * 3/2004 Geyer ..... F02D 41/3836 123/447
6,929,087 B1 * 8/2005 Sheppard ..... F02M 37/0023 180/417
7,438,051 B2 * 10/2008 Wachtendorf ..... F02D 41/2464 123/446
10,072,601 B2 * 9/2018 Hermann ..... F02D 41/062
2006/0000448 A1 * 1/2006 Ricco ..... F02M 63/0225 123/447
2007/0295310 A1 * 12/2007 Achleitner ..... F02D 41/3082 123/495
2009/0050110 A1 * 2/2009 Ricco ..... F02M 59/102 123/447
2009/0177366 A1 * 7/2009 Achleitner ..... F02D 41/0087 701/103
2014/0103233 A1 * 4/2014 Sewcz ..... F04B 49/22 251/12
2015/0204286 A1 * 7/2015 Prodi ..... F02D 41/3845 123/499
2017/0276087 A1 * 9/2017 Behrendt ..... F02D 41/123
2017/0328295 A1 * 11/2017 Mancini ..... F02D 41/3082
2018/0030916 A1 * 2/2018 Nabi ..... F02D 41/263

FOREIGN PATENT DOCUMENTS

DE 102004062613 A1 7/2006
DE 102013220419 A1 4/2015
DE 102014214284 A1 1/2016

* cited by examiner

METHOD FOR ASCERTAINING A SETPOINT VALUE FOR A MANIPULATED VARIABLE FOR ACTIVATING A LOW-PRESSURE PUMP

FIELD

The present invention relates to a method for ascertaining a setpoint value for a manipulated variable for activating a low-pressure pump as well as a processing unit and a computer program for carrying it out.

BACKGROUND INFORMATION

In modern motor vehicles which include internal combustion engines, one or multiple electric fuel pumps are used as low-pressure pumps in low-pressure fuel systems, i.e., in the low-pressure area of the fuel supply, in particular in the form of so-called pre-supply pumps, with the aid of which the fuel is delivered from a fuel tank to a high-pressure pump.

The advantages of fast availability due to the pre-supply of fuel to an electric fuel pump at startup are thus combined with the advantages of the hydraulic efficiency of a high-pressure pump driven with the aid of the internal combustion engine. Moreover, the fuel supply may take place according to need. An electric fuel pump generally requires a separate control or regulation and includes electronics for this purpose, which may be integrated, for example, into the fuel pump.

For example, a method for operating a low-pressure pump is described in German Patent Application No. DE 101 58 950 C2 for supplying a high-pressure pump with fuel, via which the fuel, in turn, is delivered to a high-pressure accumulator. A precontrol value for a pressure provided by the low-pressure pump is set, taking into account a pressure temperature relationship and the occurrence of a cavitation in the high-pressure pump after lowering the pressure provided by the low-pressure pump. A cavitation of this type is detected on the basis of an instability of a pressure regulation for the high-pressure accumulator.

SUMMARY

According to the present invention, a method is provided for ascertaining a setpoint value for a manipulated variable for activating a low-pressure pump as well as a processing unit and a computer program for carrying it out. Advantageous example embodiments of the present invention are described herein.

A method according to the present invention is used to ascertain a setpoint value for a manipulated variable for activating a low-pressure pump in a fuel supply system for an internal combustion engine, including a high-pressure accumulator and a high-pressure pump having a volume control valve. Within the scope of the present invention, a setpoint value for a manipulated variable for activating a low-pressure pump may be ascertained, in particular, in such a way that a desired admission pressure is present at the high-pressure pump. An example of a desired admission pressure is characterized in that it is as low as possible and as high as necessary. A preferred manipulated variable is an amplitude and/or a duty factor (e.g., for PWM) of a drive current and/or a drive voltage of an electric motor of the low-pressure pump.

The volume control valve is used to set the delivery rate of the high-pressure pump. The volume control valve may thus, for example, be initially still open toward the low-pressure area during a delivery phase, so that fuel is initially still pressed back into the low-pressure area, and fuel is then delivered to the high-pressure accumulator via a suitable outlet valve only upon the closing of the volume control valve. A currentless closed volume control valve or a currentless open volume control valve may be used as the volume control valve. The difference is that, in the latter case, a corresponding solenoid coil must be energized to permit a closing of the valve, while in the former case, a closing of the valve is possible when the solenoid valve is not energized. To hold the valve open, a suitable spring may be used in each case, which presses against a closing spring. Reference is made at this point to the description of the figures for a detailed description of a volume control valve of this type.

The low-pressure pump is now activated by varying the value of the manipulated variable in such a way that a pressure provided by the low-pressure pump (admission pressure for the high-pressure pump) is reduced across multiple intake phases, in which fuel delivered by the low-pressure pump is sucked in by the high-pressure pump via the volume control valve. No ascertainment of the actual pressure is needed for this purpose, but instead, for example, a drive current or another suitable manipulated variable may be simply reduced, whereby the pressure built up with the aid of the low-pressure pump, which may be, for example, an electric fuel pump, is reduced. The reduction may take place, for example, continuously or step by step.

During each of the multiple intake phases, the volume control valve is at least temporarily held in a closed position, in which it may be opened by applying pressure from a side facing the low-pressure pump. Depending on whether a currentless closed or a currentless open volume control valve is used, an energization may take place or not take place for this purpose during the corresponding period of time. In this closed position, the volume control valve is held closed and not continuously open with the aid of the aforementioned closing spring. If sufficient pressure now prevails on the side facing the low-pressure pump, or if a sufficiently high underpressure is built up on a side of the volume control pump facing a delivery or intake volume of the high-pressure pump, the volume control valve may be opened by the fuel.

The setpoint value is now ascertained, taking into account an activating value of the manipulated variable, in which a drop in a delivery rate of the high-pressure pump is detected, in particular during an intake phase. In this way, a setpoint value for the manipulated variable may be ascertained without using a pressure sensor in the low-pressure area, in which the desired admission pressure is present at the high-pressure pump, an adequately high pressure, in particular, being provided, on the one hand, to avoid impairing the desired delivery rate of the high-pressure pump, and a not unnecessarily high pressure being built up, on the other hand, which is not needed to provide the desired delivery rate of the high-pressure pump. For example, the aforementioned activating value may be used as the setpoint value, it being advantageously possible, however, to add a suitable offset. In this way, the low-pressure pump may provide a suitable pressure even without regulation, which would require a pressure sensor in the low-pressure area.

The provided method furthermore makes use of the fact that, due to the use of the aforementioned closed position of the volume control valve during the intake phases, a pressure drop via the volume control valve may be implemented during the intake phases. If the volume control valve is continuously open during the intake phase, steam may form in the area of the volume control valve only in very limited operating ranges, which is necessary to induce a drop in the delivery rate of the high-pressure pump. Instead, steam preferably forms in the area of hot components, which, however, are not usually in the area of the volume control valve. In the case of a steam formation of this type, the delivery volume of the high-pressure pump is not completely filled with fuel but partially also with steam, which must be first compressed in the delivery phase, whereby the delivery rate drops.

Since, in the provided method, the volume control valve may be pressed, and also must be pressed, against the closing spring in the intake phase, due to the fuel, a pressure drop via the volume control valve occurs. This pressure drop, i.e., a reduced pressure in the area of the delivery volume, causes a faster and more effective steam formation. In this way, the operating ranges in which the drop in the delivery rate is induced and may also be sufficiently accurately detected, are significantly expanded. This affects, for example, additional rotational speed ranges and additional temperature ranges. In particular, for example, pressures below 1 bar may be achieved in this way, which are advantageous for steam formation, which is difficult to achieve solely by activating the low-pressure pump.

The volume control valve is preferably held in the closed position, starting at a delivery phase, which precedes the particular intake phase and in which fuel is delivered by the high-pressure pump to the high-pressure accumulator. In the delivery phase, the volume control valve is brought into the closed position, so that fuel is delivered to the high-pressure accumulator via an outlet valve by reducing the intake or delivery volume, due to the piston movement in the high-pressure pump. Since the delivery phase is followed by an intake phase, the closed position may be maintained. This is advantageous, in particular when using a currentless open volume control valve, since an energizing of the solenoid coil of the volume control valve is necessary to maintain the closed position. A suitable holding current may thus be maintained, which is generally lower than a pull-in current for the initial pulling of the armature, which would otherwise have to be raised again.

The drop in the delivery rate of the high-pressure pump is advantageously detected, taking into account a change during the course of a regulation of a pressure in the high-pressure accumulator. It may be advantageous if the change during the course of the regulation of the pressure in the high-pressure accumulator includes a change in a control variable (actual value) and/or a change and/or a request to change a manipulated variable for regulating the pressure in the high-pressure accumulator. The pressure in the high-pressure accumulator is generally regulated during the course of a regulation using the pressure as the control variable. For example, a delivery angle may be used as the manipulated variable, i.e., for example, an angle of the camshaft of the internal combustion engine, via which a piston of the high-pressure pump is moved up and down.

Once the pressure in the high-pressure accumulator drops, to counteract the pressure drop, the angle of the camshaft starting at which the closed position of the volume control valve is assumed may therefore be adjusted in the advance direction to increase the delivery rate. Accordingly, variables in connection with the regulation of the pressure in the high-pressure accumulator permit a reliable detection of a drop in the delivery rate.

Alternatively or additionally, it is preferred if the drop in the delivery rate of the high-pressure pump is detected, taking into account a change in a pressure increase in the high-pressure accumulator. For this purpose, the high-pressure pump is operated at full delivery to detect the drop in the delivery rate, i.e., the delivery of fuel takes place throughout the entire lift phase of the piston, i.e., from the bottom dead center to the top dead center. If the delivery volume is now reduced, due to the steam formation, the delivery volume may no longer be further increased, and the pressure increase in the high-pressure accumulator is smaller.

The high-pressure pump is preferably operated at full delivery with the aid of a two-point regulation. A two-point regulation of this type is an operation of the high-pressure pump, in which only when the pressure in the high-pressure accumulator drops below a setpoint pressure is a full delivery always carried out until this, or possibly another slightly higher, setpoint pressure is exceeded. The pressure in the high-pressure accumulator is then slowly reduced between two pressure increases by the removal of fuel for injection into the internal combustion engine. An operating mode of this type is generally provided for a high-pressure pump anyway, so that the provided method may be carried out very easily and quickly.

The volume control valve is preferably held in the closed position starting in an intake phase preceding the particular delivery phase, in particular a delivery phase at full delivery, until after the start of the delivery phase, in which fuel is delivered by the high-pressure pump (into high-pressure accumulator (160)). During operation at full delivery, the volume control valve may be held in the closed position throughout the entire intake phase, so that the volume control valve must be pressed against the closing spring by the fuel in this intake phase, and the desired pressure drop via the volume control valve occurs. Afterwards, the volume control valve may be held beyond the bottom dead center into the delivery phase to trigger the full delivery. This is advantageous, in particular when using a currentless open volume control valve, since an energization of the solenoid coil of the volume control valve is necessary to maintain the closed position. A suitable holding current may thus be maintained, which is generally lower than a pull-in current for the initial pulling of the armature, which would otherwise have to be raised again.

The method is preferably carried out for different fuel temperatures, so that setpoint values for different fuel temperatures are ascertained. For example, the fuel temperature in the high-pressure pump is taken into account, since the drop in the delivery function of the high-pressure pump is triggered in this location by the steam formation of the fuel. The fuel temperature in the high-pressure pump may be measured or also estimated with the aid of a suitable fuel temperature model. As a result, the low-pressure pump may be activated on this basis at any (arbitrary) fuel temperature (e.g., by interpolation or extrapolation), using a suitable setpoint value for the manipulated variable, so that the desired admission pressure is present at the high-pressure pump independently of the fuel temperature.

A processing unit according to the present invention, e.g., a control unit of a motor vehicle, is configured to carry out a method according to the present invention, in particular from a programming point of view.

It is also advantageous to implement the method in the form of a computer program, since this is particularly cost-effective, in particular when an executing control unit is used for other tasks and is thus present anyway. Suitable data carriers for providing the computer program are, in particular, magnetic, optical and electrical memories, such as hard disks, flash memories, EEPROMs, DVDs, among other things. Downloading a program via computer networks (Internet, intranet, etc.) is also possible.

Further advantages and embodiments of the present invention result from the description below and the figures.

The present invention is schematically illustrated in the figures on the basis of an exemplary embodiment and is described below with reference to the figures.

DETAILED DESCRIPTION OF EXAMPLE EMBODIMENTS

Figure 1:
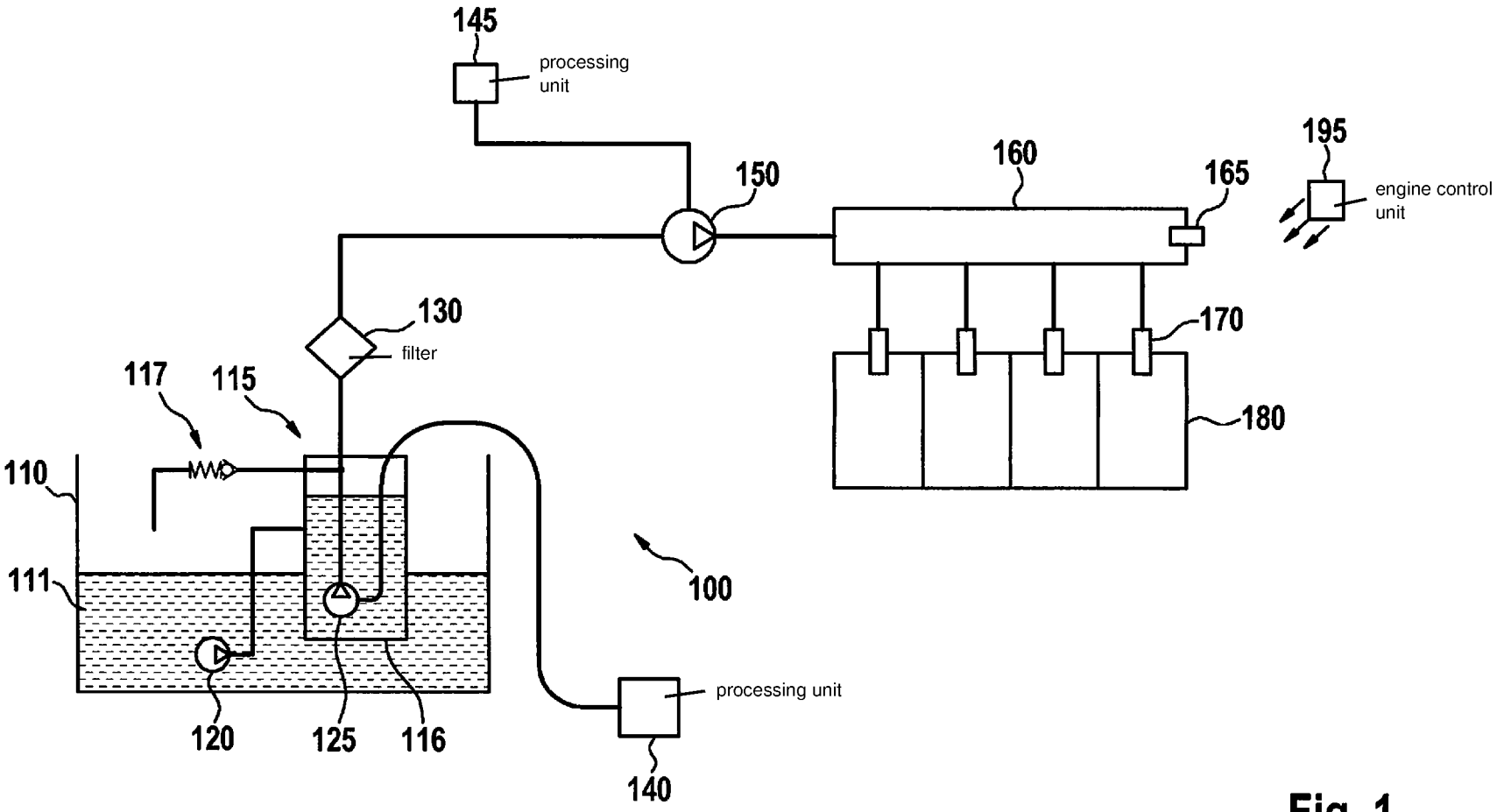
FIG. 1 schematically shows a fuel supply system for an internal combustion engine, which may be used for a method according to the present invention.

A fuel supply system 100 for an internal combustion engine 180, which may be used for a method according to the present invention, is schematically shown in FIG. 1.

Fuel supply system 100 includes a fuel tank 110, which is filled with fuel 111. An in-tank unit 115 is situated in fuel tank 110, which, in turn, includes a pre-supply vessel 116, in which a low-pressure pump 125 is situated, for example in the form of an electric fuel pump.

Pre-supply vessel 115 may be filled with fuel from fuel tank 110 via a suction jet pump 120 (or possibly also multiple suction jet pumps) situated outside the pre-supply vessel in fuel tank 110. Electric fuel pump 125 may be activated via a processing unit 140, designed as a pump control unit in this case, so that fuel is delivered from pre-supply vessel 115 to a high-pressure pump 150 via a filter 130.

Figure 2:
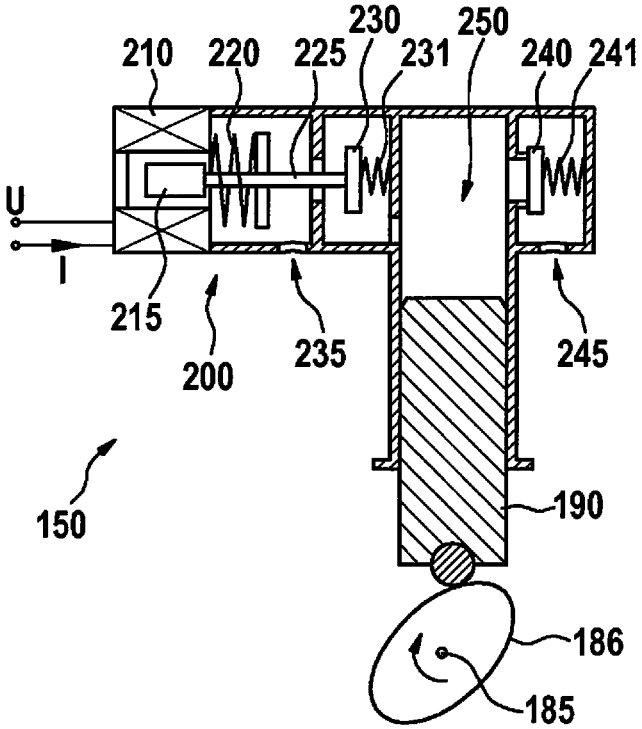
FIG. 2 schematically shows a high-pressure pump, including a volume control valve.

Reference is made at this point to FIG. 2 for a more detailed description of high-pressure pump 150, which is activated in this case via a processing unit 145 designed as another pump control unit. In addition, a pressure limiting valve 117 is provided in the low-pressure line.

High-pressure pump 150 is generally driven via internal combustion engine 180 and its camshaft. The fuel is then delivered by high-pressure pump 150 to a high-pressure accumulator 160, from where the fuel may be fed to internal combustion engine 180 via fuel injectors 170. A pressure sensor 165 is furthermore provided on high-pressure accumulator 160, with the aid of which a pressure in the high-pressure accumulator may be detected.

An activation of internal combustion engine 180 and fuel injectors 170 may take place via an engine control unit 195, which is different from pump control units 140 and 145, the control units then being able to communicate with each other. However, it is also possible to use a shared control unit.

FIG. 2 schematically shows a high-pressure pump 150, including a volume control valve 200, in greater detail than in FIG. 1. High-pressure pump 150 includes a piston 190, which is moved up and down via a cam 186 on a camshaft 185 of the internal combustion engine. A delivery volume 250 is decreased or increased in this way.

Volume control valve 200 has an inlet opening 235, via which fuel provided by the low-pressure pump may enter delivery volume 250. An opening which follows inlet opening 235 may be closed with the aid of an inlet valve 230, using a closing spring 231, which is part of volume control valve 200.

A solenoid coil 210, which may be part of an electromagnet, is also provided, which may be supplied with a voltage U and energized with a current I. Voltage U and current I may be provided, for example, via corresponding pump control unit 145.

A spring 220 is furthermore shown, which presses a bolt 225, on whose end facing the solenoid coil an armature 215 is fastened, in the direction of inlet valve 230. When solenoid coil 210 is not energized, inlet valve 230 is thus continuously held open. It is thus a currentless open volume control valve. It should be noted in this regard that the spring force of spring 220 is greater than that of closing spring 231.

If solenoid coil 210 is now energized with a sufficiently high current, bolt 225 is moved against spring 220 with the aid of armature 215. In this way, inlet valve 225 is closed by closing spring 231; however, it may be opened by the application of pressure.

An outlet valve 240 is furthermore provided with a closing spring 241, via which fuel may be delivered from delivery volume 250 to the high-pressure accumulator via an outlet opening 245.

Figure 3:
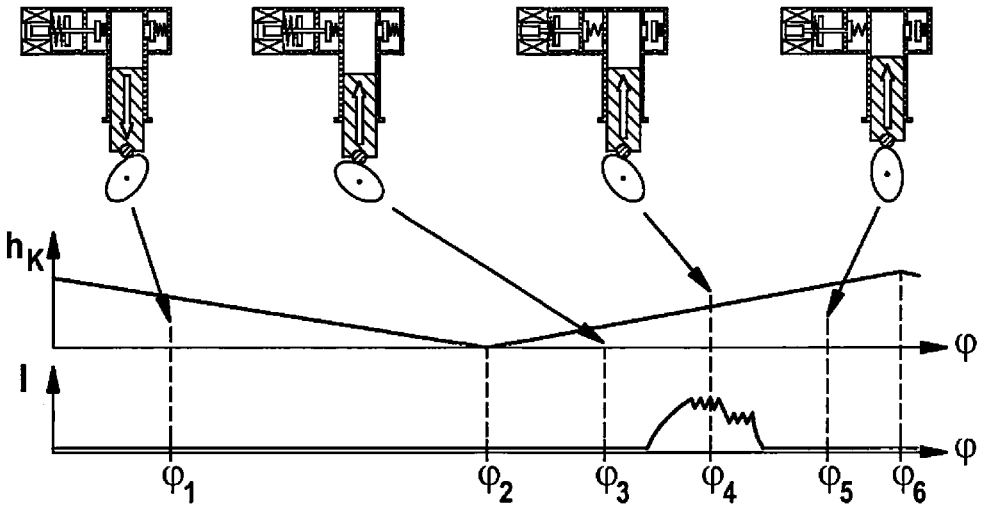
FIG. 3 shows profiles of a lift of a piston of the high-pressure pump and a current of an associated volume control valve in a method not according to the present invention.

FIG. 3 shows profiles of a lift $h_K$ of the piston of the high-pressure pump and current I of the associated volume control valve, in a method not according to the present invention, over a camshaft angle or angle $\varphi$ in each case. The high-pressure pump, including a volume control valve, as described in greater detail with reference to FIG. 2, is also shown in a particular position for different angles.

The piston of the high-pressure pump is initially in a downward movement, due to the rotation of the cam, as is illustrated by way of example by the position of the high-pressure pump for angle $\varphi_1$. This is an intake phase, i.e. fuel provided by the low-pressure pump is sucked into the delivery volume of the high-pressure pump. The volume control valve is not energized for this purpose and is thus continuously open. In this way, fuel may flow into the delivery volume unhindered. The outlet valve is closed.

At angle $\varphi_2$, the bottom dead center of the piston is reached, and the intake phase is ended. The piston then moves again upward in the direction of the top dead center, as is illustrated by way of example by the position of the high-pressure pump for angle $\varphi_3$. The volume control valve is still continuously open, which means that fuel from the delivery volume is initially pressed back again into the low-pressure area via the inlet opening.

Only during the upward movement of the piston is the solenoid coil energized with a current I, so that the armature releases the inlet valve using the bolt, and it may close, as is illustrated by way of example by the position of the high-pressure pump for angle $\varphi_4$. As is apparent in the area around angle $\varphi_4$, the current may initially include a pull-in current and then a slightly lower holding current, so that the armature may continue to be held pulled after the pulling.

As soon as the volume control valve or the inlet valve is able to close, the fuel is now no longer delivered from the delivery volume back into the low-pressure area but into the high-pressure accumulator via the outlet valve and the outlet opening, as is illustrated by way of example by the position of the high-pressure pump for angle $\varphi_5$. The delivery is ended only when the piston reaches the top dead center at angle $\varphi_6$.

It should be noted in this regard that current I may already be canceled before reaching the top dead center, since the inlet valve also remains closed against the opening force of the spring, due to the high pressure in the delivery volume. The delivery rate and thus the pressure buildup in the high-pressure accumulator may be set or regulated by suitably selecting the point in time or the corresponding angle at which the volume control valve is closed.

Figure 4:
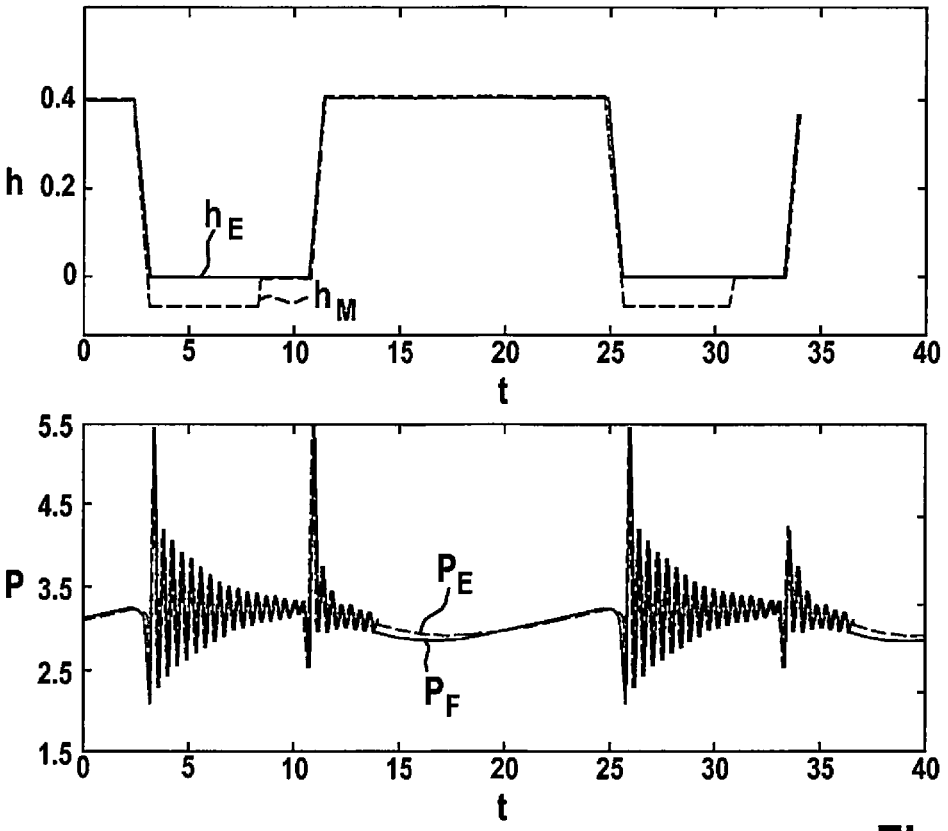
FIG. 4 shows profiles of valve lifts and pressures in a volume control valve in the method illustrated in FIG. 3.

FIG. 4 shows profiles of valve lifts h and pressures P in bar in the volume control valve in the method illustrated in FIG. 3, in ms over time t in each case. While $h_M$ shows the lift of the armature, the lift of the inlet valve is illustrated by $h_E$. $P_E$ shows an associated pressure at the inlet valve, and $P_F$ shows an associated pressure in the delivery volume. The profiles over time between approximately 3 ms and approximately 11 ms more or less correspond to the situations illustrated in FIG. 3 between angles $\varphi_4$ and $\varphi_6$, which correspond to the delivery phase starting at the closure of the volume control valve, due to the energization. The profiles between approximately 11 ms and approximately 26 ms, however, more or less correspond to the situations illustrated in FIG. 3 between angles $\varphi_6$ and $\varphi_4$, which correspond to the intake phase and the delivery phase up to prior to the closure of the volume control valve.

It is apparent from the profiles of the pressures during the intake phase that pressure $P_E$ at the inlet valve and pressure $P_F$ in the delivery volume are nearly identical. At the most, a very slight pressure drop is apparent from the inlet valve in the direction of the delivery volume. This means that almost no steam formation is able to take place at the inlet valve, for which reason a drop in the delivery rate is also difficult to detect, as was explained at the outset.

Figure 5:
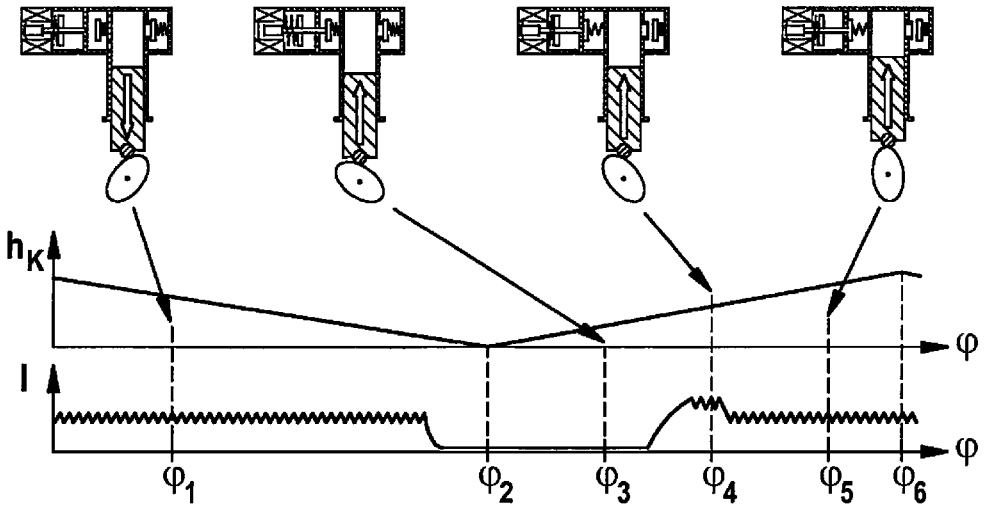
FIG. 5 shows profiles of a lift of a piston of the high-pressure pump and a current of an associated volume control valve in a method according to the present invention in a preferred specific embodiment.

FIG. 5 shows profiles of lift $h_K$ of the piston of the high-pressure pump and current I of the associated volume control valve, in a method according to the present invention, in a preferred specific embodiment, over a camshaft angle or angle $\varphi$ in each case.

The high-pressure pump, including a volume control valve, as described in greater detail with reference to FIG. 2, is also shown in a particular position for different angles. In this case, the profile corresponds to the one illustrated in FIG. 3, but with the difference that the activating current, which sets in shortly before angle $\varphi_4$, is not yet ended during the delivery phase, i.e., the upward movement of the piston, but rather continues to be maintained.

This results in the fact that current I is still present in the subsequent intake phase, as is apparent here on the left side of the profile. The activating current is canceled in this case only shortly before the end of the intake phase, i.e. shortly before reaching the bottom dead center at angle $\varphi_2$.

During the intake phase, the volume control valve is thus in a closed position, in which it may be opened by applying pressure on the part of the low-pressure pump, as is illustrated by way of example by the position of the high-pressure pump for angle $\varphi_1$.

Figure 6:
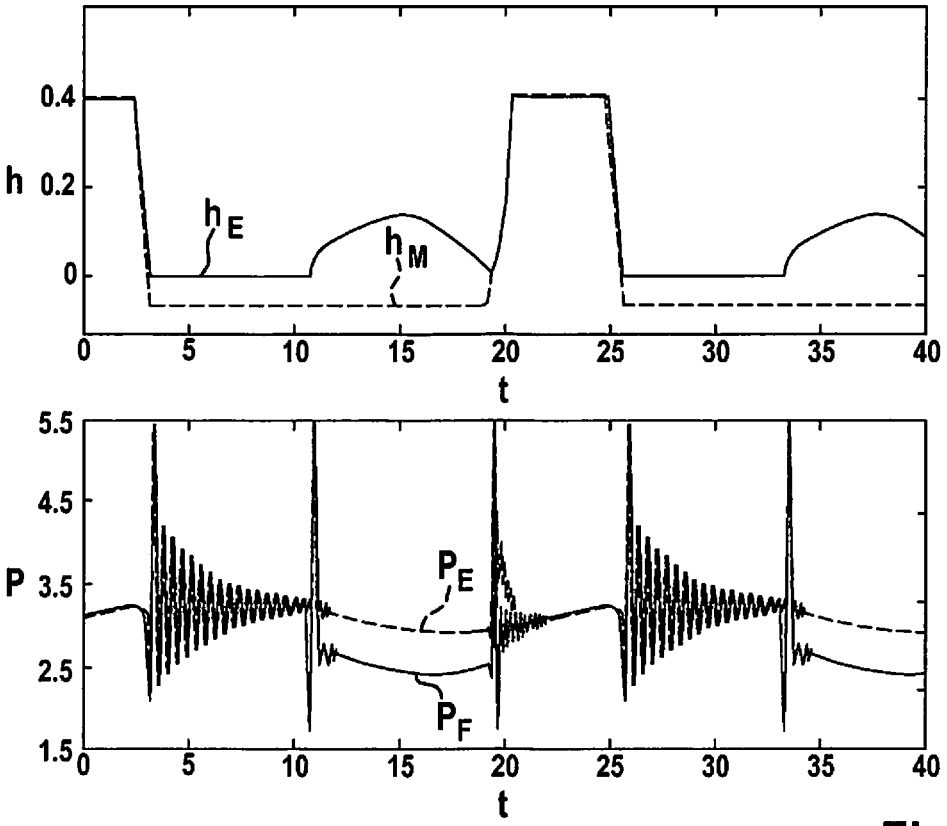
FIG. 6 shows profiles of valve lifts and pressures in a volume control valve in the method illustrated in FIG. 5.

FIG. 6 shows the associated profiles of valve lifts h and pressures P in the volume control valve, in ms over time t in each case. As in FIG. 4, $h_M$ in this case also shows the lift of the armature and $h_E$ shows the lift of the inlet valve. $P_E$ shows an associated pressure at the inlet valve, and $P_F$ shows an associated pressure in the delivery volume.

The profiles over time between approximately 3 ms and approximately 20 ms more or less correspond to the situations illustrated in FIG. 3 between angles $\varphi_4$ and $\varphi_2$. Compared to FIG. 4, it is apparent that lift $h_E$ of the inlet valve according to FIG. 6 is much smaller in the time between approximately 11 ms and approximately 20 ms, i.e., in the intake phase. This is due to the fact that the inlet valve is not held open continuously but is only opened by the fuel flow during the intake phase, thus resulting in a pressure drop.

This furthermore results in the fact that pressure $P_E$ at the inlet valve and pressure $P_F$ in the delivery volume are significantly different during the intake phase, i.e., in the time between approximately 11 ms and approximately 20 ms. A pressure drop of approximately 0.5 bar is apparent here, whereby the steam formation in the delivery volume is favored. As already explained in detail at the outset, this results in a much easier and better detection of the drop in the delivery rate in other operating ranges. The setpoint value for the manipulated variable for activating the low-pressure pump may thus be very easily ascertained.

The profile of activating current I illustrated in FIG. 5 may also be used, in particular, only during a time period in which the setpoint value is to be ascertained. Otherwise, i.e. during regular operation, the profile illustrated in FIG. 3 may continue to be used. It should furthermore be noted that the profile of the activating current is more or less the opposite, i.e., when using a currentless closed volume control valve.

Figure 7:
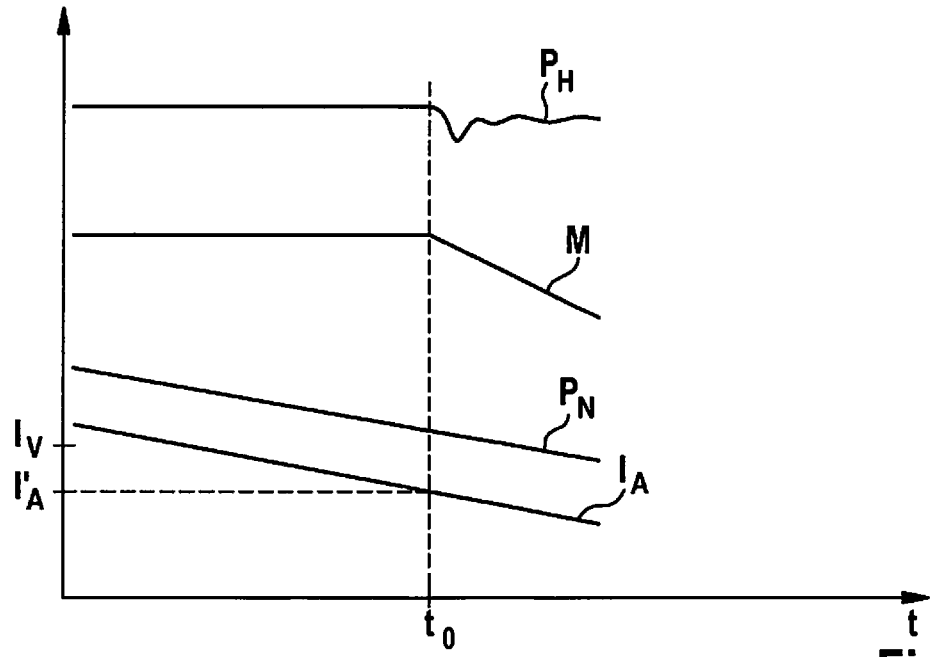
FIG. 7 schematically shows a sequence of a method according to the present invention in a preferred specific embodiment, based on different variables.

FIG. 7 schematically shows a sequence of a method according to the present invention in a preferred specific embodiment, based on different variables. Profiles of a manipulated variable of the low-pressure pump, in this case an activating current $I_A$, an associated pressure $P_N$ provided by the low-pressure pump, a delivery rate M of the high-pressure pump and a pressure $P_H$ in the high-pressure accumulator, are illustrated for this purpose, over time t in each case.

Activating current $I_A$ of the low-pressure pump may now be reduced when a setpoint value is to be ascertained, for example continuously across multiple intake phases of the high-pressure pump. Accordingly, pressure $P_N$ provided thereby is reduced, which, however, does not have to be measured. Delivery rate M initially still remains constant, so that pressure $P_H$ in the high-pressure accumulator may be well regulated and maintained.

At point in time to, the point should now be reached, at which the steam formation in the delivery volume of the high-pressure pump has decreased so much, due to further decreasing pressure $P_N$, that the delivery rate drops. The drop in delivery rate M now results, for example, in a short-term reduction of pressure $P_H$ in the high-pressure accumulator, which, on the one hand, may be measured directly, but which, on the other hand, may also be detected during the course of the regulation of this pressure, based on controller variables.

Activating value $I'_A$ used for the activating current at point in time to may now be used to ascertain setpoint value $I_V$. For example, a suitable offset may be easily added for this purpose.

Setpoint values for different fuel temperatures are preferably ascertained, so that a suitable setpoint value for the manipulated variable, the activating current in this case, may be used for each fuel temperature (e.g. by interpolation or extrapolation) in such a way that a desired admission pressure is present at the high-pressure pump. A desired admission pressure is characterized, in particular, in that it is as low as possible and as high as necessary.

What is claimed is:

1. A method for ascertaining a setpoint value for a manipulated variable for activating a low-pressure pump in a fuel supply system for an internal combustion engine, including a high-pressure accumulator and a high-pressure pump including a volume control valve, the method comprising:

activating the low-pressure pump by varying a value of the manipulated variable in such a way that a pressure provided by the low-pressure pump is reduced across multiple intake phases, in which fuel delivered by the low-pressure pump is sucked in by the high-pressure pump via the volume control valve;

during each of the multiple intake phases: (i) at least temporarily holding the volume control valve in a closed position, and then (ii) opening the volume control valve, from the temporarily held closed position, by applying pressure to the volume control valve from a side of the volume control valve facing the low-pressure pump, the pressure being applied to open the volume control valve by a fuel flow from the low-pressure pump; and ascertaining the setpoint value, based on an activating value of the manipulated variable at which a drop in a delivery rate of the high-pressure pump is detected.

2. The method as recited in claim 1, wherein the volume control valve is held in the closed position, starting at a delivery phase preceding the intake phase, in which fuel is delivered by the high-pressure pump into the high-pressure accumulator.

3. The method as recited in claim 1, wherein the drop in the delivery rate of the high-pressure pump is detected, taking into account a change during the course of a regulation of a pressure in the high-pressure accumulator.

4. The method as recited in claim 3, wherein the change during the course of the regulation of the pressure in the high-pressure accumulator includes a change in a control variable.

5. The method as recited in claim 1, wherein the drop in the delivery rate of the high-pressure pump is detected, taking into account a change in a pressure increase in the high-pressure accumulator.

6. The method as recited in claim 5, wherein the high-pressure pump is operated at full delivery to detect the drop in the delivery rate using a two-point regulation.

7. The method as recited in claim 5, wherein the volume control valve is held in the closed position, starting at an intake phase preceding a particular delivery phase up until after the start of a delivery phase, in which fuel is delivered by the high-pressure pump into the high-pressure accumulator.

8. The method as recited in claim 1, wherein the low-pressure pump is activated using the ascertained setpoint value for the manipulated variable.

9. The method as recited in claim 1, wherein the setpoint value is ascertained as a function of a fuel temperature.

10. The method as recited in claim 1, wherein a currentless closed or currentless open volume control valve is used as the volume control valve.

11. The method as recited in claim 1, wherein during each of the multiple intake phases, the at least temporarily holding of the volume control valve in the closed position includes at least temporarily holding the volume control valve in the closed position using a closing spring.

12. The method as recited in claim 11, wherein during each of the multiple intake phases, the volume control valve is opened from the temporarily held closed position only by applying the pressure to the volume control valve from the side of the volume control valve facing the low-pressure pump by the fuel flow from the low-pressure pump.

13. A processing unit, which is configured to ascertain a setpoint value for a manipulated variable for activating a low-pressure pump in a fuel supply system for an internal combustion engine, including a high-pressure accumulator and a high-pressure pump including a volume control valve, the processing unit configured to:

activate the low-pressure pump by varying a value of the manipulated variable in such a way that a pressure provided by the low-pressure pump is reduced across multiple intake phases, in which fuel delivered by the low-pressure pump is sucked in by the high-pressure pump via the volume control valve;

during each of the multiple intake phases: (i) at least temporarily hold the volume control valve in a closed position, and then (ii) open the volume control valve, from the temporarily held closed position, by applying pressure to the volume control valve from a side of the volume control valve facing the low-pressure pump, the pressure being applied to open the volume control valve by a fuel flow from the low-pressure pump; and ascertain the setpoint value, based on an activating value of the manipulated variable at which a drop in a delivery rate of the high-pressure pump is detected.

14. The processing unit as recited in claim 13, wherein during each of the multiple intake phases, the at least temporarily holding of the volume control valve in the closed position includes at least temporarily holding the volume control valve in the closed position using a closing spring.

15. The processing unit as recited in claim 14, wherein during each of the multiple intake phases, the volume control valve is opened from the temporarily held closed position only by applying the pressure to the volume control valve from the side of the volume control valve facing the low-pressure pump by the fuel flow from the low-pressure pump.

16. A non-transitory computer-readable medium on which is stored a computer program for ascertaining a setpoint value for a manipulated variable for activating a low-pressure pump in a fuel supply system for an internal combustion engine, including a high-pressure accumulator and a high-pressure pump including a volume control valve, the computer program, when executed by a processing unit, causing the processing unit to perform:

activating the low-pressure pump by varying the value of the manipulated variable in such a way that a pressure provided by the low-pressure pump is reduced across multiple intake phases, in which fuel delivered by the low-pressure pump is sucked in by the high-pressure pump via the volume control valve;

during each of the multiple intake phases: (i) at least temporarily holding the volume control valve in a closed position, and then (i) opening the volume control valve, from the temporarily held closed position, by applying pressure to the volume control valve from a side of the volume control valve facing the low-pressure pump, the pressure being applied to open the volume control valve by a fuel flow from the low-pressure pump; and ascertaining the setpoint value, based on an activating value of the manipulated variable at which a drop in a delivery rate of the high-pressure pump is detected.

17. The non-transitory computer-readable medium as recited in claim 16, wherein during each of the multiple intake phases, the at least temporarily holding of the volume control valve in the closed position includes at least temporarily holding the volume control valve in the closed position using a closing spring.

18. The non-transitory computer-readable medium as recited in claim 17, wherein during each of the multiple intake phases, the volume control valve is opened from the temporarily held closed position only by applying the pressure to the volume control valve from the side of the volume control valve facing the low-pressure pump by the fuel flow from the low-pressure pump.

* * * * *